US011807034B2

(12) United States Patent
Wilson

(10) Patent No.: US 11,807,034 B2
(45) Date of Patent: Nov. 7, 2023

(54) CHALK BOX WITH NOZZLE GASKET OVERMOLD

(71) Applicant: APEX BRANDS, INC., Apex, NC (US)

(72) Inventor: Cecil Wilson, Sanford, NC (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 17/618,956

(22) PCT Filed: Jun. 11, 2020

(86) PCT No.: PCT/US2020/037191
§ 371 (c)(1),
(2) Date: Dec. 14, 2021

(87) PCT Pub. No.: WO2020/257045
PCT Pub. Date: Dec. 24, 2020

(65) Prior Publication Data

US 2022/0314687 A1 Oct. 6, 2022

Related U.S. Application Data

(60) Provisional application No. 62/862,217, filed on Jun. 17, 2019.

(51) Int. Cl.
*B44D 3/38* (2006.01)

(52) U.S. Cl.
CPC ..... *B44D 3/38* (2013.01)

(58) Field of Classification Search
CPC ..... B44D 3/38
See application file for complete search history.

(56) References Cited

U.S. PATENT DOCUMENTS 7,231,722 B2 6/2007 Hickey et al.
7,624,509 B2 * 12/2009 Hanson ..... B44D 3/38 33/414

(Continued)

FOREIGN PATENT DOCUMENTS

CN 201855768 U 6/2011
CN 103429830 A 12/2013

(Continued)

OTHER PUBLICATIONS

Third Office Action (with translation) issued in corresponding Chinese Application No. 2020800442087 dated Oct. 28, 2022, all pages cited in their entirety.

(Continued)

*Primary Examiner* — Yaritza Guadalupe-McCall
(74) *Attorney, Agent, or Firm* — BURR & FORMAN LLP

(57) ABSTRACT

A nozzle for a chalk box that includes a housing and a chalk reservoir may be configured to be releasably coupled with the housing. The nozzle may include a shell, and a nozzle flange assembly configured to interface with a case flange assembly of the housing to operably couple the nozzle to the housing. The nozzle flange assembly may include a locking member. A gasket portion may be integrated into the locking member to seal an interface between the nozzle flange assembly and the case flange assembly to inhibit chalk leakage from the chalk box.

20 Claims, 11 Drawing Sheets

(56) References Cited

U.S. PATENT DOCUMENTS

| | | | | |
|---|---|---|---|---|
| 7,770,300 | B2 * | 8/2010 | Johnson | B44D 3/38 33/414 |
| 9,701,154 | B2 * | 7/2017 | Parker | B44D 3/38 |
| 9,815,320 | B2 | 11/2017 | Khangar et al. | |
| 10,071,594 | B2 * | 9/2018 | Chernyshou | B44D 3/38 |
| 11,440,343 | B2 * | 9/2022 | Beckwith | B44D 3/38 |
| 2008/0052935 | A1 | 3/2008 | Hanson et al. | |
| 2010/0011599 | A1 * | 1/2010 | Johnson | B44D 3/38 33/414 |
| 2012/0260511 | A1 * | 10/2012 | Spaulding | B44D 3/38 33/414 |
| 2016/0347117 | A1 * | 12/2016 | Parker | B44D 3/38 |
| 2020/0369073 | A1 * | 11/2020 | Cemke, Jr. | B44D 3/38 |
| 2022/0176733 | A1 * | 6/2022 | Wilson | B44D 3/38 |
| 2022/0185006 | A1 * | 6/2022 | Wilson | B44D 3/38 |
| 2022/0268367 | A1 * | 8/2022 | Wilson | F16K 15/1471 |
| 2022/0314687 | A1 * | 10/2022 | Wilson | B44D 3/38 |
| 2022/0316520 | A1 * | 10/2022 | Wilson | F16B 45/00 |

FOREIGN PATENT DOCUMENTS

| | | | |
|---|---|---|---|
| CN | 205219088 | U | 5/2016 |
| EP | 2420389 | A1 | 2/2012 |

OTHER PUBLICATIONS

First Examination Report issued in corresponding Australian Application No. 2020298074 dated Nov. 22, 2022, all enclosed pages cited in their entirety.

International Search Report and Written Opinion from International Application No. PCT/US2020/037191 dated Oct. 14, 2020, all pages cited in its entirety.

Second Office Action issued in corresponding Chinese Application No. 2020800442087 dated Jul. 29, 2022, all pages cited in their entirety.

Office Action from Chinese Application No. 2020800442087 dated Mar. 3, 2022, all pages cited in its entirety.

* cited by examiner

CHALK BOX WITH NOZZLE GASKET OVERMOLD

TECHNICAL FIELD

Example embodiments generally relate to a chalk box or chalk reel, and more particularly relate to a chalk box or chalk reel having a nozzle that is formed to provide numerous advantages over conventional chalk boxes.

BACKGROUND

A chalk box (sometimes referred to as a chalk reel or chalk line tool) is a tool for marking straight lines on surfaces. To accomplish this, the chalk box typically includes a string or line that may be made of nylon, cotton or other materials and is able to be wound or spooled up onto a reel assembly. The string is exposed to chalk (or another marking substance) within the tool. The string typically has an end hook at one end, and the end hook extends from a body of the tool. The end hook can be pulled, thereby extracting string from the reel assembly, to place the end hook at a first point that is distant from a second point near which the remainder of the tool will be retained. Alternatively, the end hook could be affixed to the first point and the remainder of the tool can be moved to the second point while withdrawing string from the reel assembly. In either case, the end hook retains the string at the first point, and the user may pull the string relatively tightly to the second point (e.g., holding the string at the second point with the user's hand or thumb). The user may then pluck or snap the string sharply, and the chalk may be transferred to the surface to mark a straight line between the first and second points. The marked line is often referred to as a chalk line and, after its formation, the user often operates a rotatable handle that is operably coupled to the reel assembly to retract the string back onto the reel or drum thereof.

The process described above, and the tool adapted for performing the process, are both very old. However, equally old in relation to this tool, is the fact that the conventional design for the tool provides an end hook that dangles or otherwise extends from a nozzle at one end thereof. The nozzle must ultimately allow the string to pass therethrough while preventing or substantially reducing chalk leakage. Accordingly, the attachment of the nozzle to the housing of the chalk box and the chalk reservoir therein must also be relatively leak-proof. This leakage prevention task is traditionally performed by inserting a rubber gasket or "O-ring" between the nozzle and the chalk box case body or housing. This traditional design therefore has a higher part count and requires additional assembly steps to be performed in order to manufacture the chalk box. The traditional design also has a higher potential for presenting the operator difficulty in relation to performing chalk filling operations through removal of the nozzle since the gasket will need to be displaced and could require manual repositioning during the process.

BRIEF SUMMARY OF SOME EXAMPLES

Some example embodiments may enable the provision of a chalk box that has an improved design, which enables the mouth or nozzle to be attached to the chalk box without any rubber gasket or O-ring. Accordingly, the disadvantages discussed above may be overcome.

In an example embodiment, a chalk box (also known as a chalk reel or chalk line tool) is provided. The chalk box may include a housing having an aperture, a reel assembly enclosed within the housing, a string having a first end operably coupled to an end hook and configured to extend from the housing through the aperture and having a second end configured to be wound on the reel assembly, a chalk reservoir in which the string is retained or through which the string passes prior to extending out of the aperture, and a nozzle. The nozzle may be configured to be releasably coupled with the housing. The nozzle may include a shell, and a nozzle flange assembly configured to interface with a case flange assembly of the housing to operably couple the nozzle to the housing. The nozzle flange assembly may include a locking member. A gasket portion may be integrated into the locking member to seal an interface between the nozzle flange assembly and the case flange assembly to inhibit chalk leakage from the chalk box.

In another example embodiment, a nozzle for a chalk box is provided. The chalk box may include a housing and a chalk reservoir. The nozzle may be configured to be releasably coupled with the housing. The nozzle may include a shell, and a nozzle flange assembly configured to interface with a case flange assembly of the housing to operably couple the nozzle to the housing. The nozzle flange assembly may include a locking member. A gasket portion may be integrated into the locking member to seal an interface between the nozzle flange assembly and the case flange assembly to inhibit chalk leakage from the chalk box.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 2:
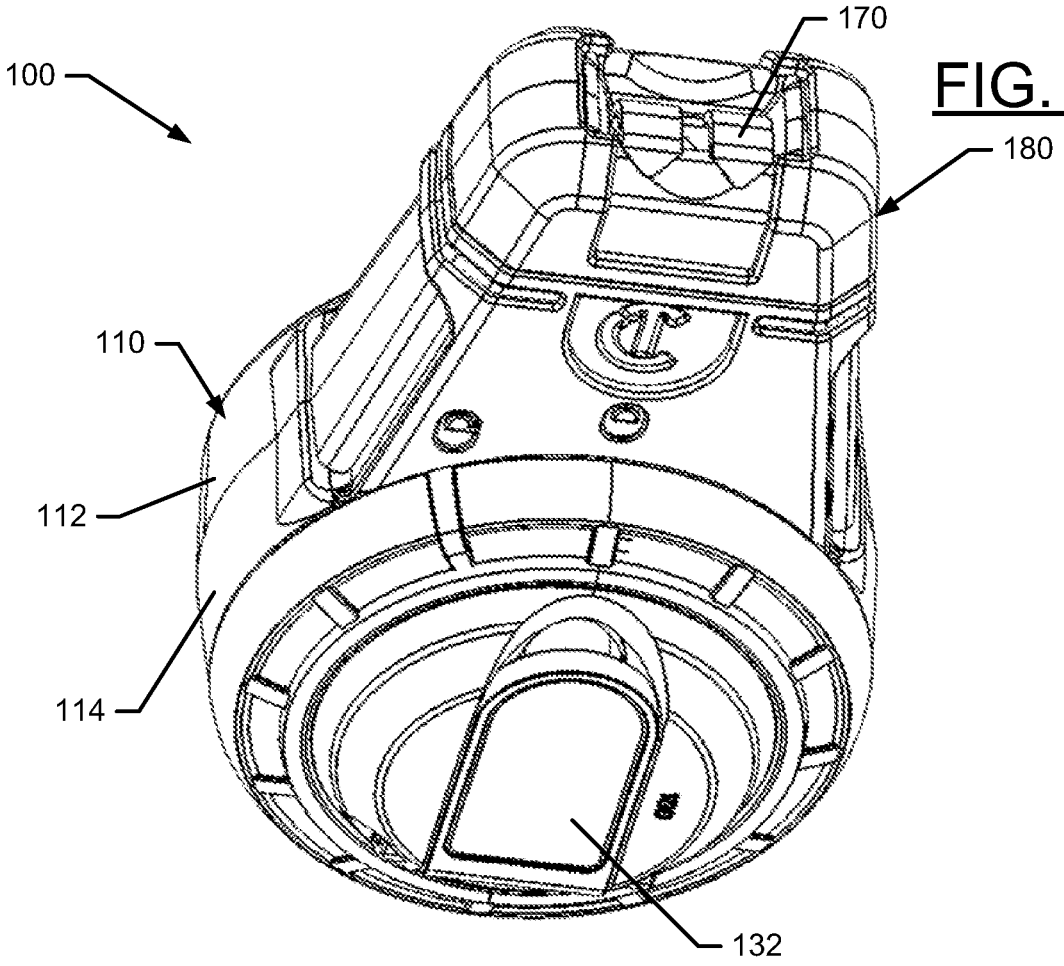
FIG. 2 illustrates a front perspective view of the chalk box in accordance with an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 1:
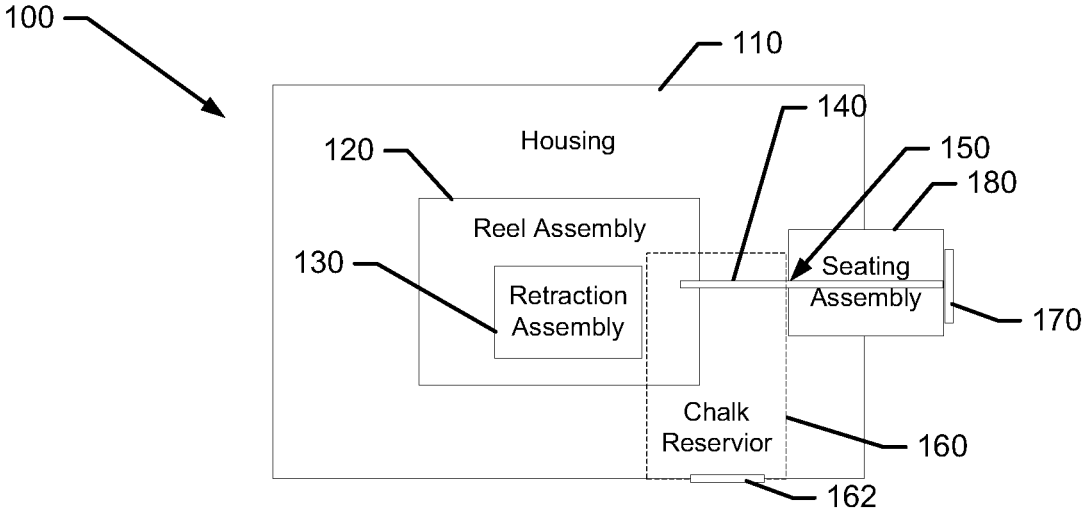
FIG. 1 illustrates a block diagram of a chalk box in accordance with an example embodiment.
Figure 3:
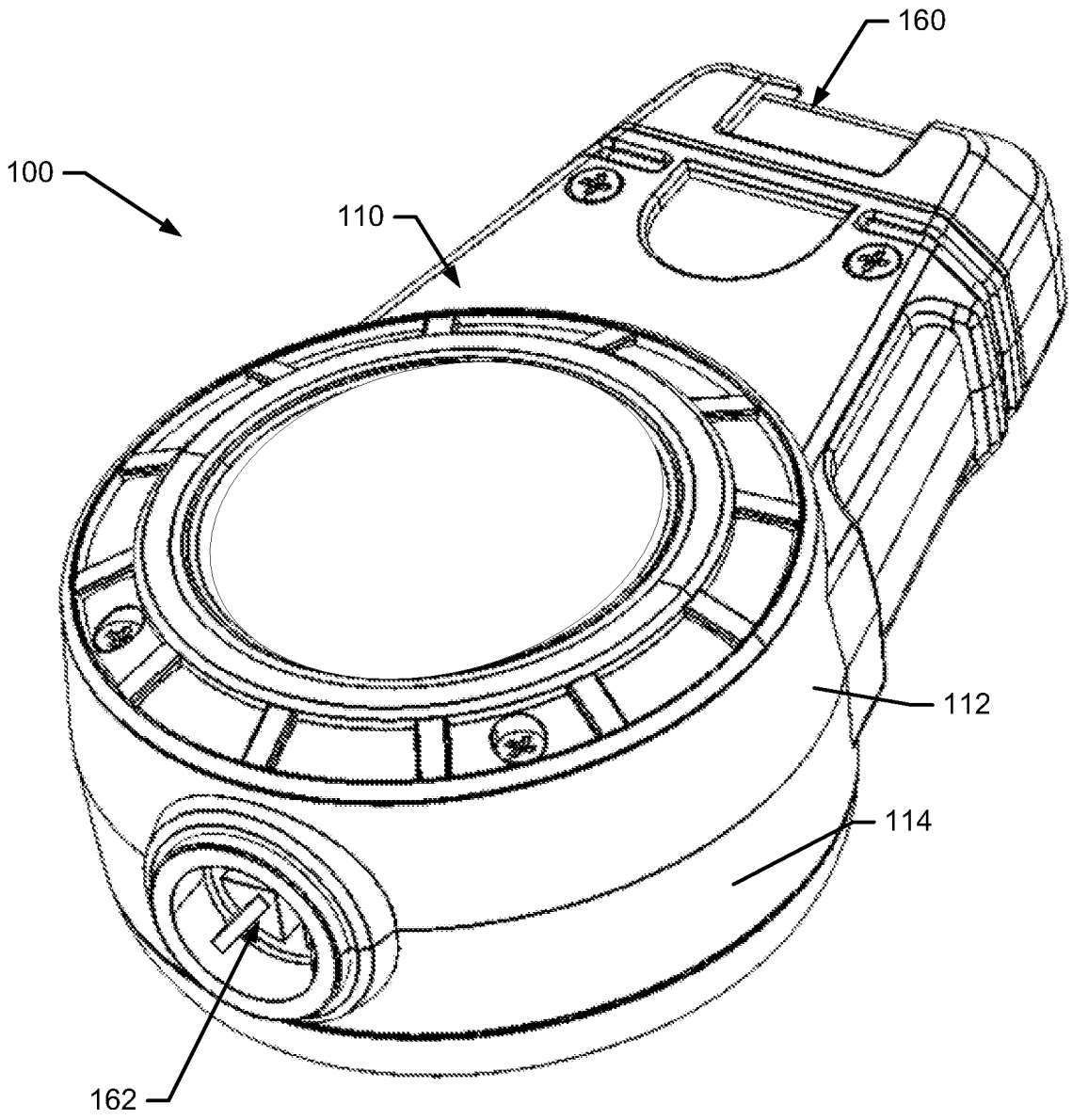
FIG. 3 illustrates a rear perspective view of the chalk box in accordance with an example embodiment.
Figure 4:
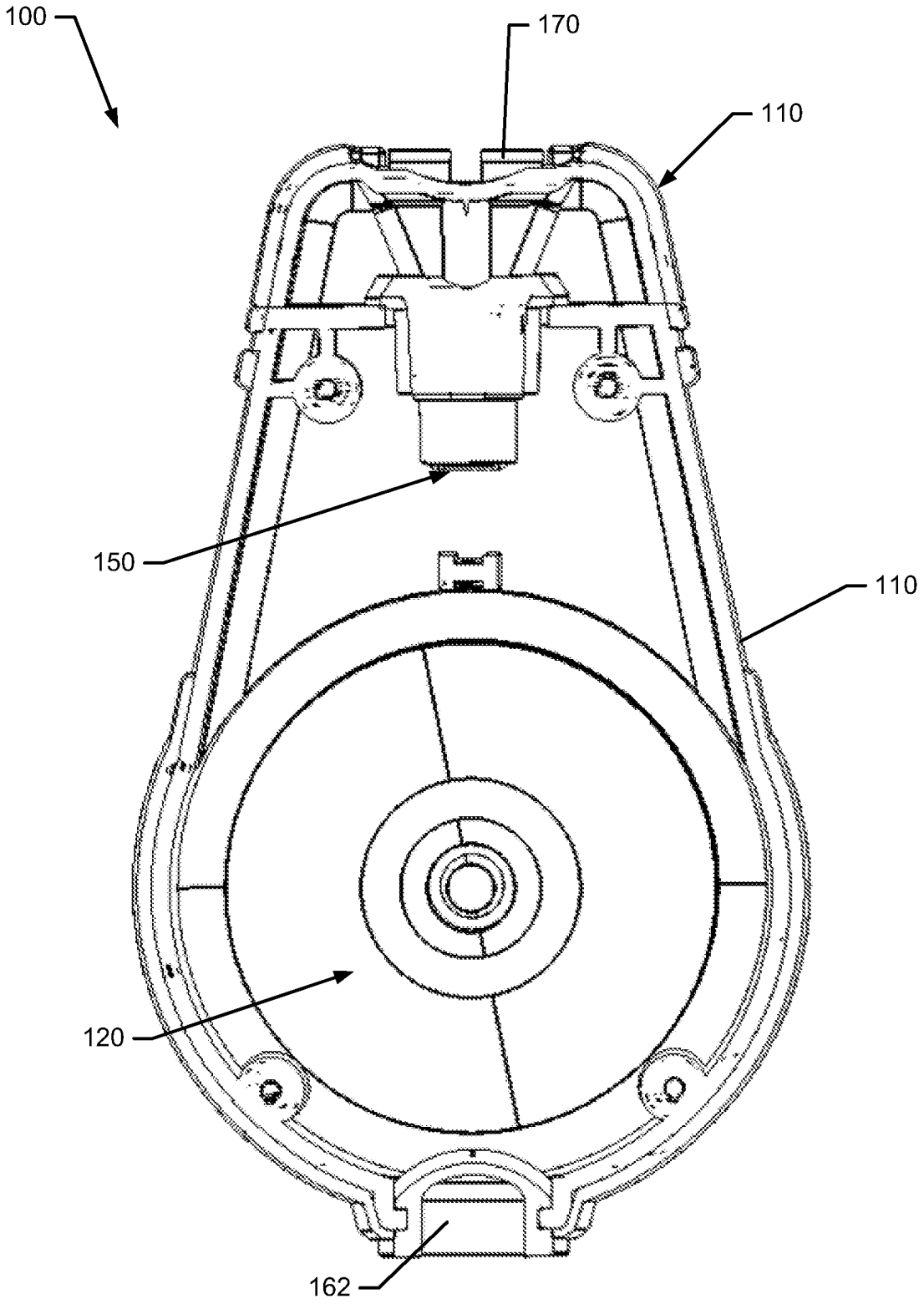
FIG. 4 illustrates a cross section view taken along a plane passing through the intersection between case halves of the chalk box in accordance with an example embodiment.
Figure 5:
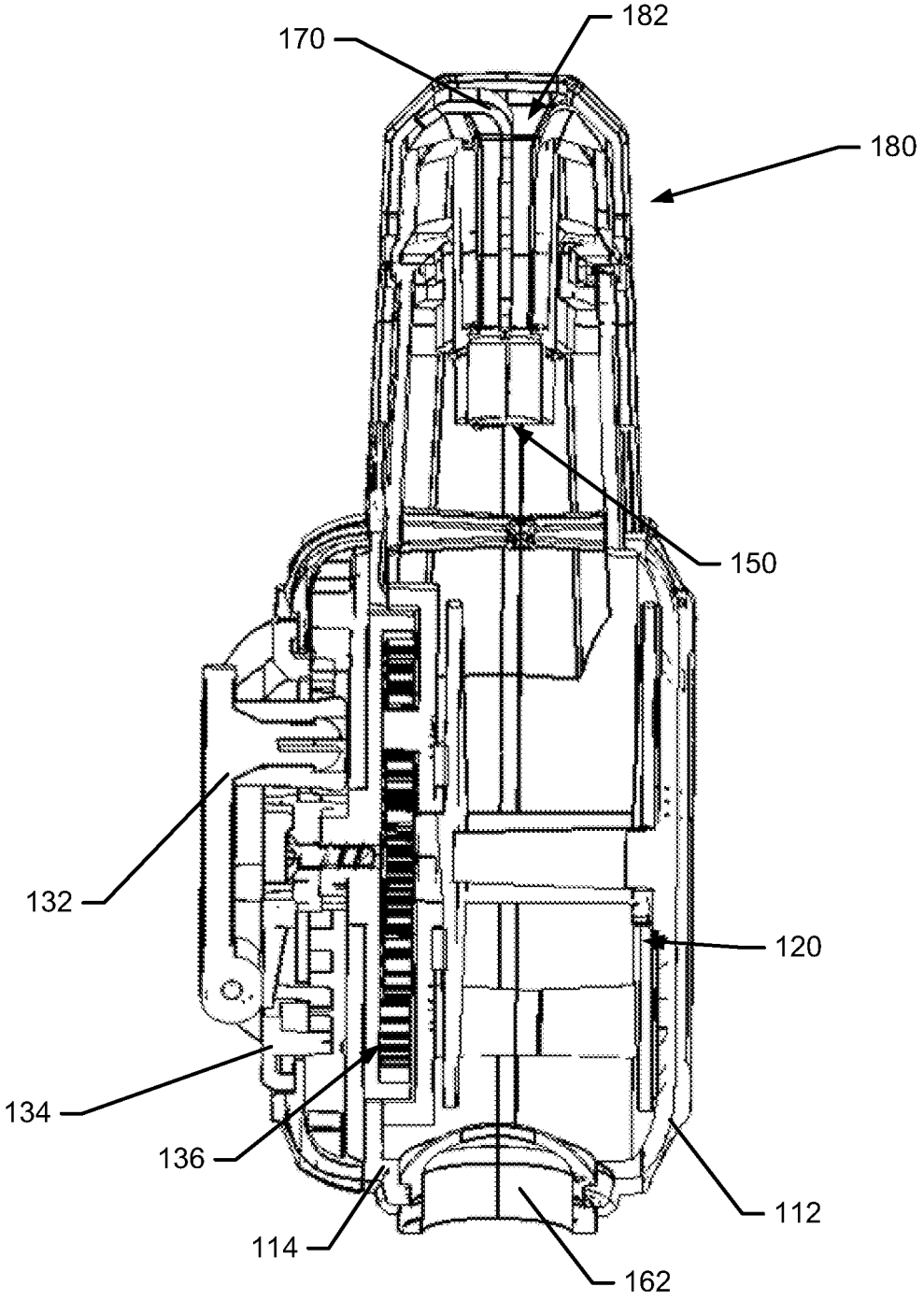
FIG. 5 is a cross section view taken along a longitudinal centerline of the chalk box via a plane that is perpendicular to the plane mentioned above in reference to FIG. 4 in accordance with an example embodiment.

As indicated above, some example embodiments may relate to the provision of a chalk box that may have an improved design for retention of a majority portion of the end hook. This may be accomplished by providing a seating assembly as described herein. FIG. 1 illustrates a block diagram of a chalk box 100 in accordance with an example embodiment, and FIGS. 2 and 3 illustrate front and rear perspective views, respectively, of the chalk box. FIG. 4 illustrates a cross section view taken along a plane passing through the intersection between case halves of the chalk box. FIG. 5 is a cross section view taken along a longitudinal centerline of the chalk box via a plane that is perpendicular to the plane mentioned above in reference to FIG. 4. FIGS. 6-9 illustrate various portions of a nozzle of the chalk box 100 in accordance with an example embodiment.

Referring now to FIGS. 1-5, a chalk box 100 of an example embodiment may include a housing 110 comprising a first case half 112 and a second case half 114. The first and second case halves 112 and 114 may house a reel assembly 120 and a retraction assembly 130 therein. A string 140 (or line) may be wound onto the reel assembly 120 and may be alternately withdrawn from and retracted back onto the reel assembly 120. The retraction back onto the reel assembly 120 may be accomplished via the retraction assembly 130, which may include a foldable handle 132 that is folded in to nest into a portion of the second case half 114, and folded out in order to enable the user to turn the handle 132. When the handle 132 is folded out and turned, a hub 134 rotates and is operably coupled to a gear assembly (see gear assembly 136 of FIG. 5) that may provide multiple rotations of a drum or reel of the reel assembly 120 for each respective rotation of the handle 132.

The string 140 may be paid out through an aperture 150 formed in a portion of the housing 110. The aperture 150 may be formed to be slightly larger than a diameter of the string 140, and may further house or retain a filter or wiping member, such as a piece of felt or other material that prevents excess escape of chalk from a chalk reservoir 160 that is exposed to the string 140 while the string 140 is inside the housing 110, and also removes excess chalk from the string 140 as the string 140 is withdrawn from the housing 110. The felt may be held in place by a retaining wire or other structure. The string 140 may therefore pass through or be retained in the chalk reservoir 160 before passing out the aperture 150. In an example embodiment, the chalk reservoir 160 may include a plug 162 that is accessible from outside the housing 110 to be removed to enable refilling of the chalk reservoir 160. The plug 162 of this example is located at a bottom portion of the housing 110, but other locations for the plug 162 are also possible.

The string 140 has an end hook 170 disposed at one end thereof, and is affixed to the reel assembly 120 at the other end of the string 140. The end hook 170 may be affixed (temporarily) to an anchor point on a medium or surface that is to be marked. Once the end hook 170 is affixed to the anchor point, the string 140 may be paid out of the aperture 150 and unwound from the reel assembly 120. When a desired length of the string 140 has been paid out, the user can make any necessary markings by snapping or plucking the string 140 as described above. The end hook 170 may then be released from the anchor point, and the handle 132 may be used to operate the retraction assembly 130 to wind the string 140 back onto the reel assembly 120 by drawing the string 140 back into the housing 110 via the aperture 150.

As noted above, the end hook 170 is typically dangling, or at least substantially (i.e., more than 50% of its length or volume) extended out of the housing 110. Example embodiments prevent this arrangement by providing a seating assembly 180. The seating assembly 180 may be formed as a mouth or nozzle that includes a reception cavity 182 that is formed therein to allow the end hook 170 to be withdrawn into the reception cavity 182. When the end hook 170 is withdrawn into the reception cavity 182, the end hook 170 may be seated flush with the distal end (relative to the remainder of the housing 110) of the seating assembly 180. In other words, the end hook 170 is fully seated in a portion of the housing 110 (specifically in the reception cavity 182 of the seating assembly 180) such that substantially all of the body, back, base or spine of the end hook 170 is received or surrounded by the reception cavity 182 and only the teeth or prongs (which extend at about a 90 degree angle to the body, back, base or spine) are outside the reception cavity 182. This arrangement ensures that the end hook 170 cannot be inadvertently snagged or caught on objects, clothing and/or the like, but also creates a sleek and aesthetically pleasing appearance.

Although the example described above fully seats the end hook 170, it should be appreciated that example embodiments need not necessarily fully receive or seat the end hook 170 in the housing 110. Moreover, example embodiments relate to the manner via which the seating assembly 180 is operably coupled to the housing 110 to ensure that the chalk within the chalk reservoir 160 does not leak at the interface between the seating assembly 180 and the housing 110. FIGS. 6-9 illustrate the various structures that facilitate inhibiting leakage, while also reducing part count and simplifying assembly of the chalk box 100. It should be appreciated, however, that the structures and methods described in reference to FIGS. 6-9 need not necessarily be practiced in connection with other aspects of the chalk box 100 shown. Other chalk box designs could also employ the techniques described herein in relation to operably coupling the seating assembly 180 to the housing 110.

Figure 6A:
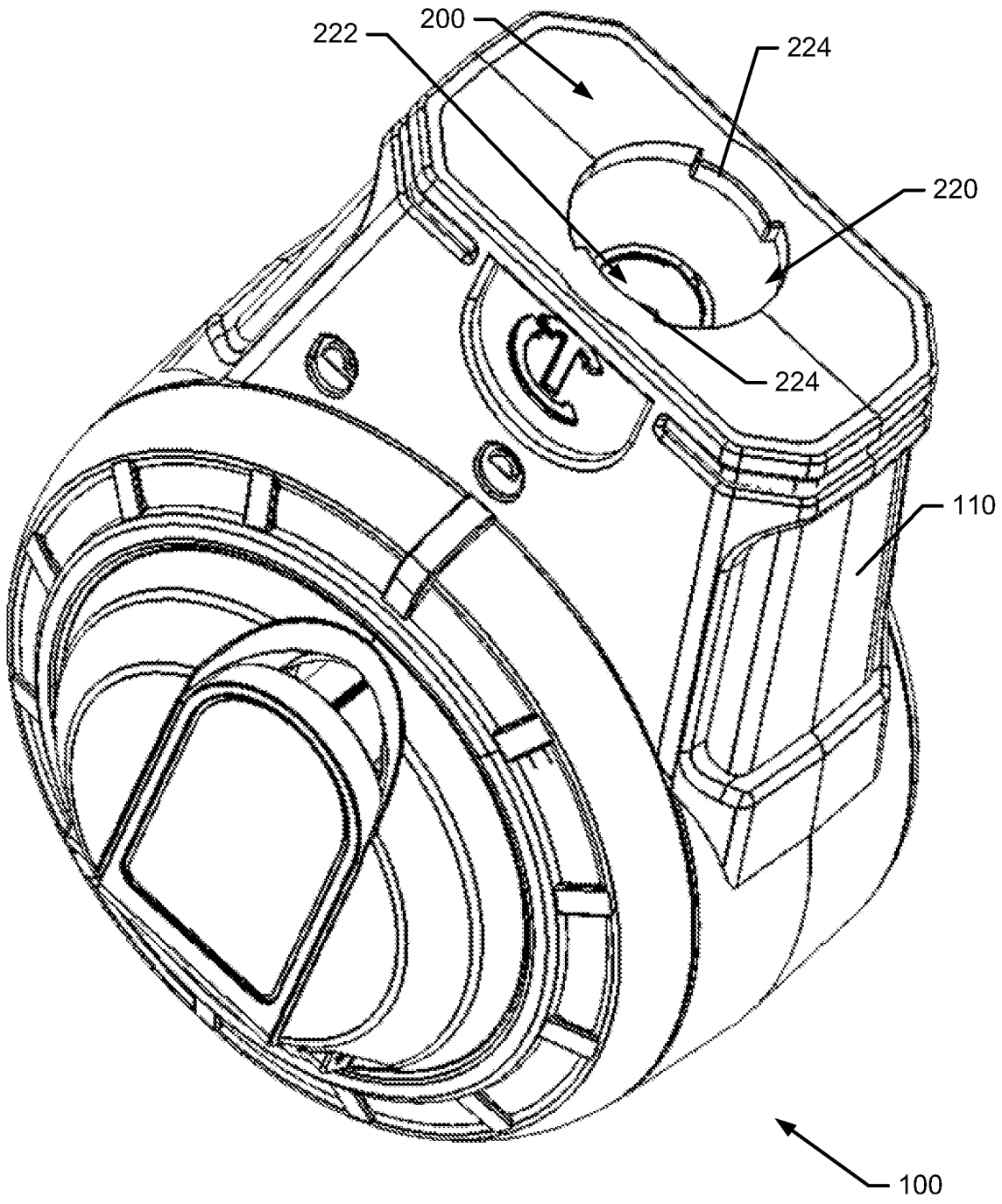
FIG. 6A illustrates a perspective view of the housing of the chalk box with the interface portion exposed and the locking member removed in accordance with an example embodiment.
Figure 6B:
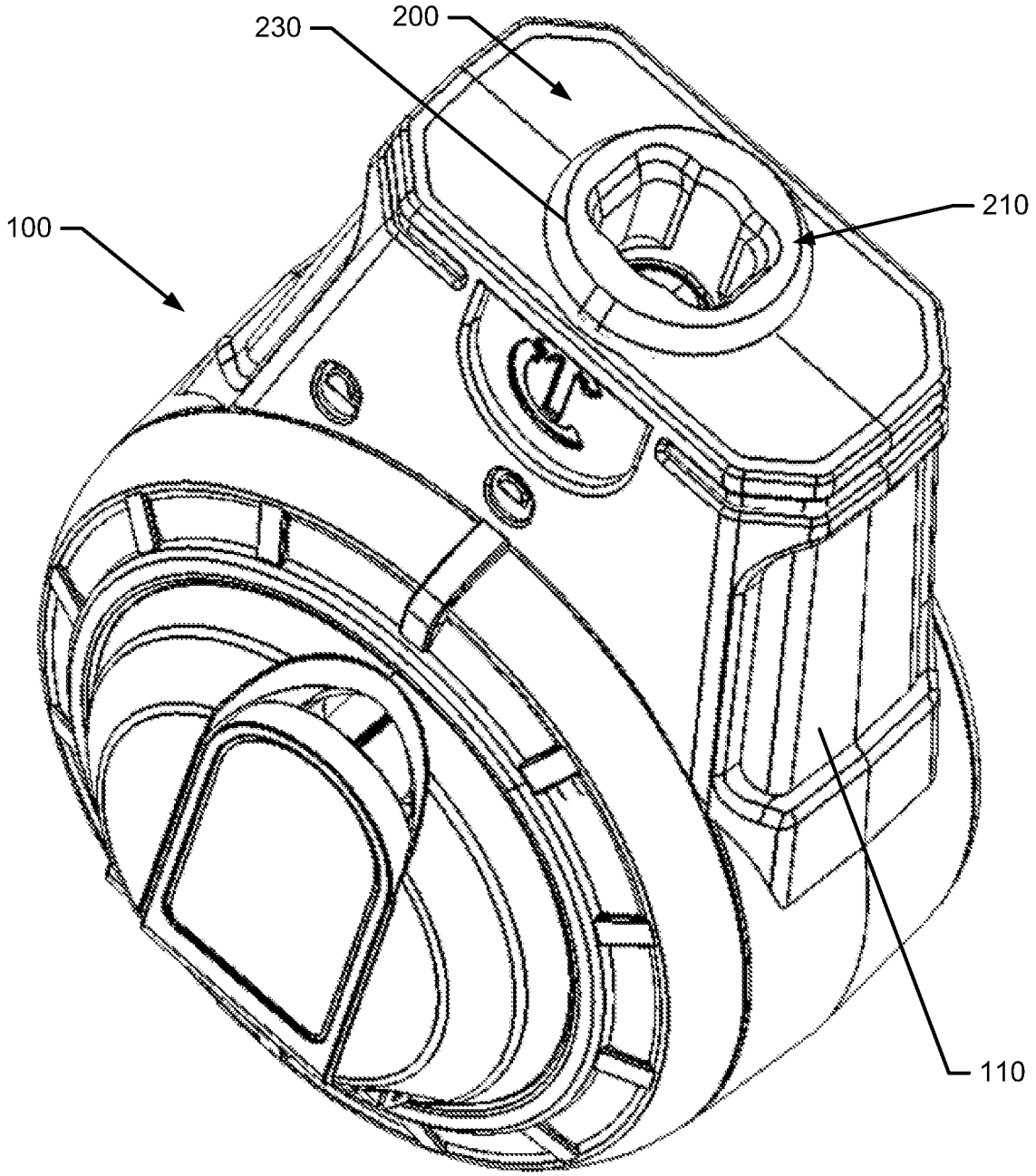
FIG. 6B illustrates a perspective view of the housing with the locking member operably coupled to the interface portion in accordance with an example embodiment.
Figure 7A:
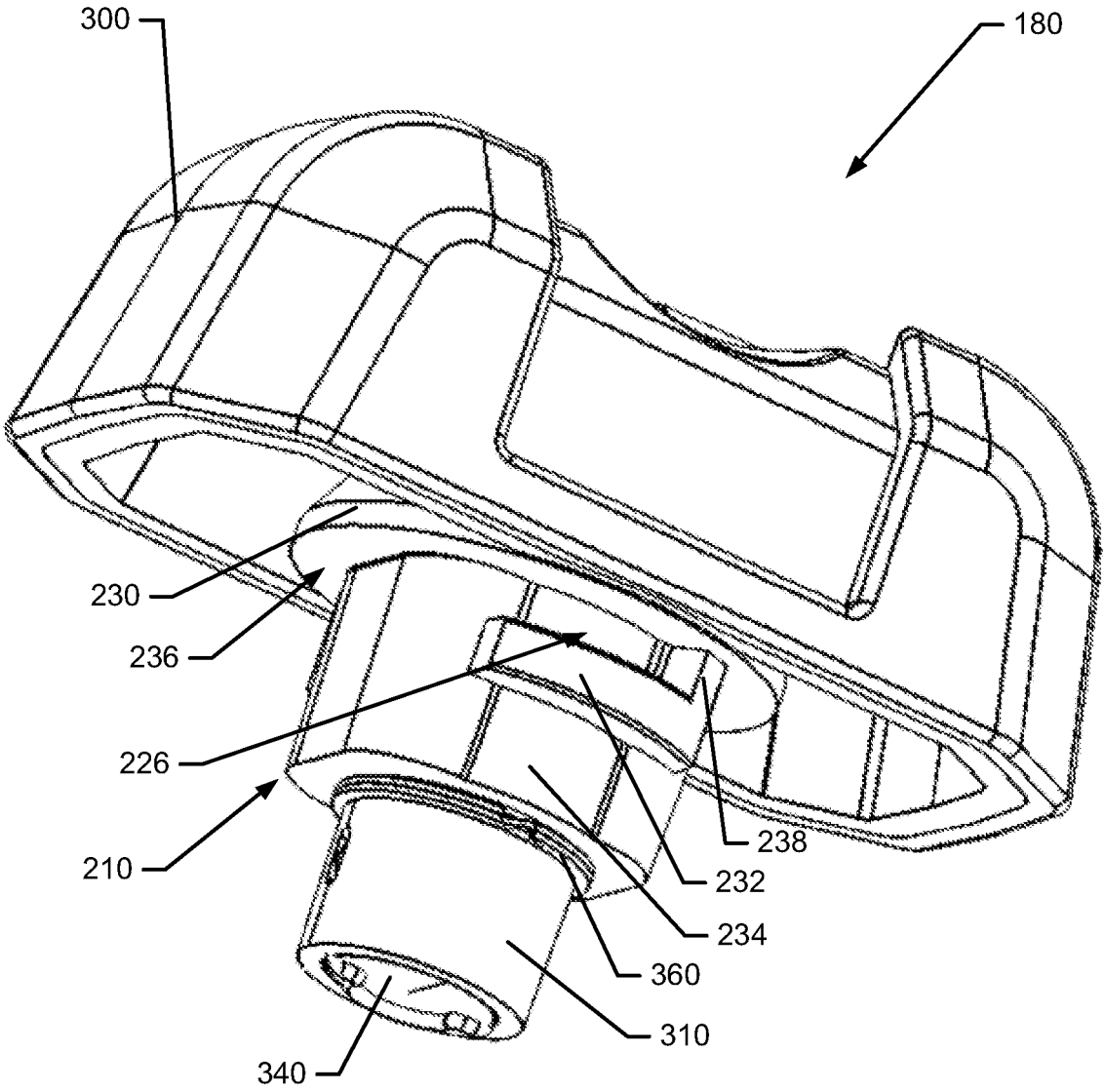
FIG. 7A illustrates a top perspective view of the seating assembly isolated from the rest of the chalk box 100 to show how the components of the seating assembly fit together when fully assembled in accordance with an example embodiment.
Figure 7B:
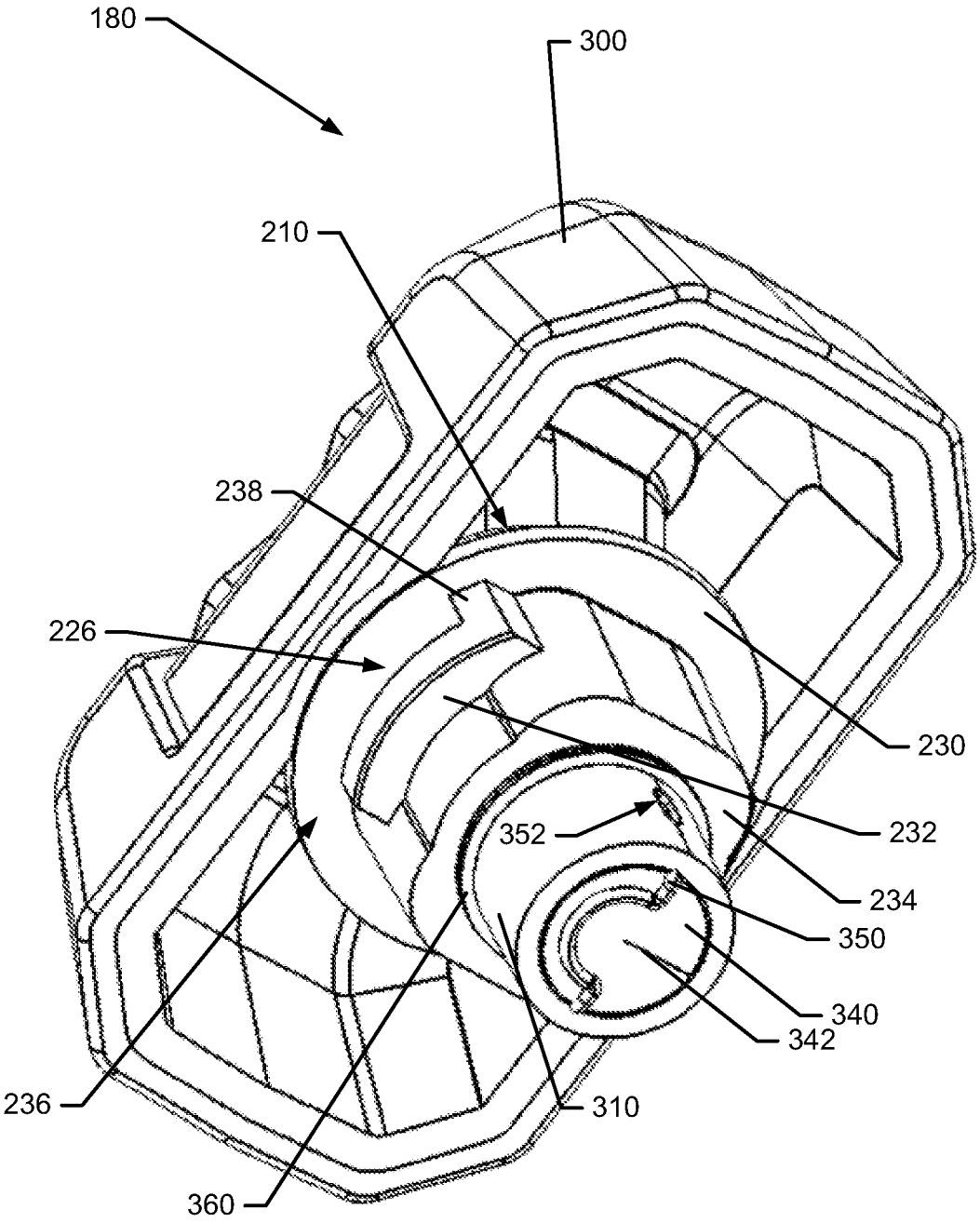
FIG. 7B is a bottom perspective view of the seating assembly of FIG. 7A in accordance with an example embodiment.
Figure 8:
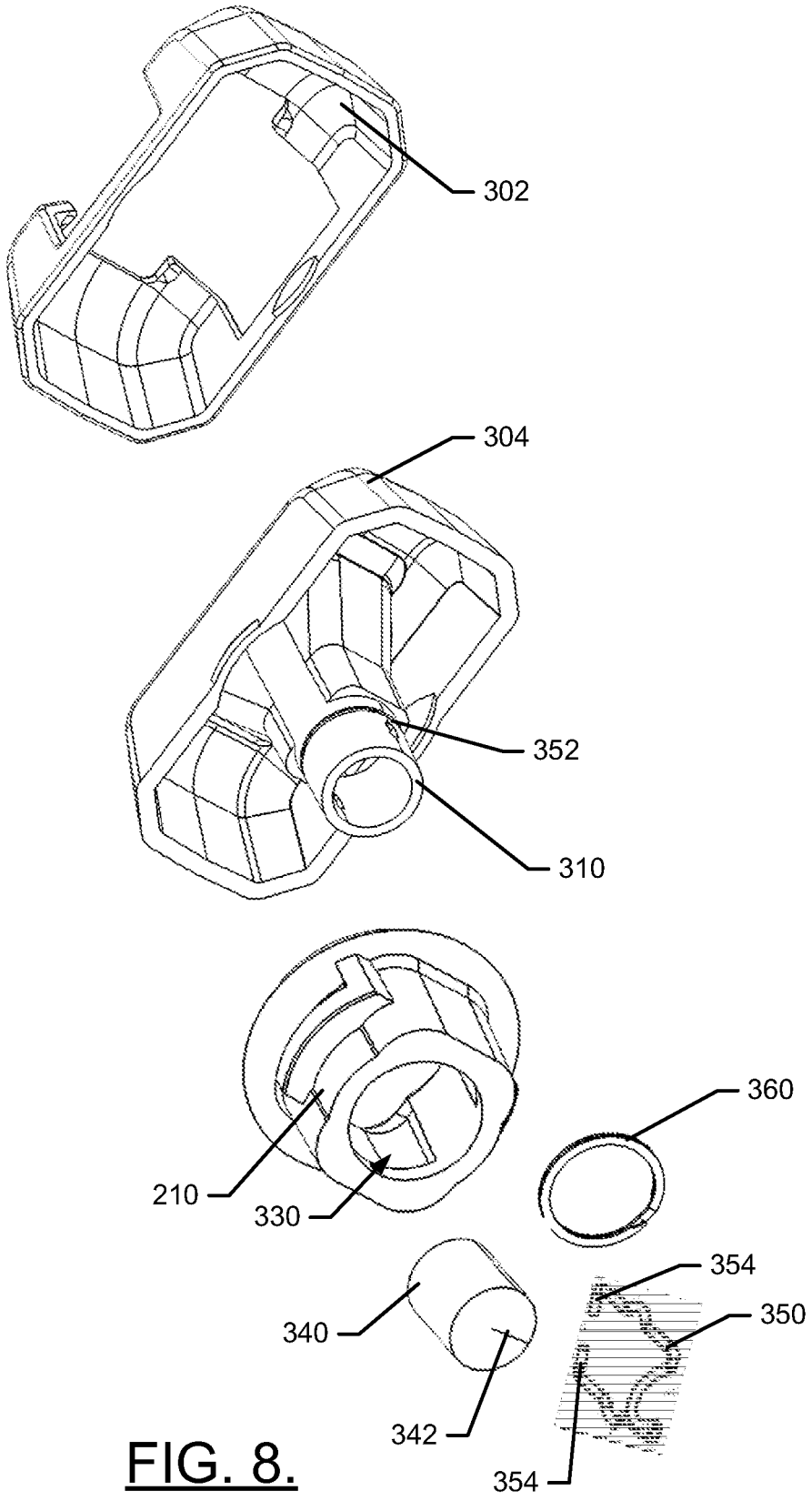
FIG. 8 illustrates an exploded view of the seating assembly in accordance with an example embodiment.
Figure 9A:
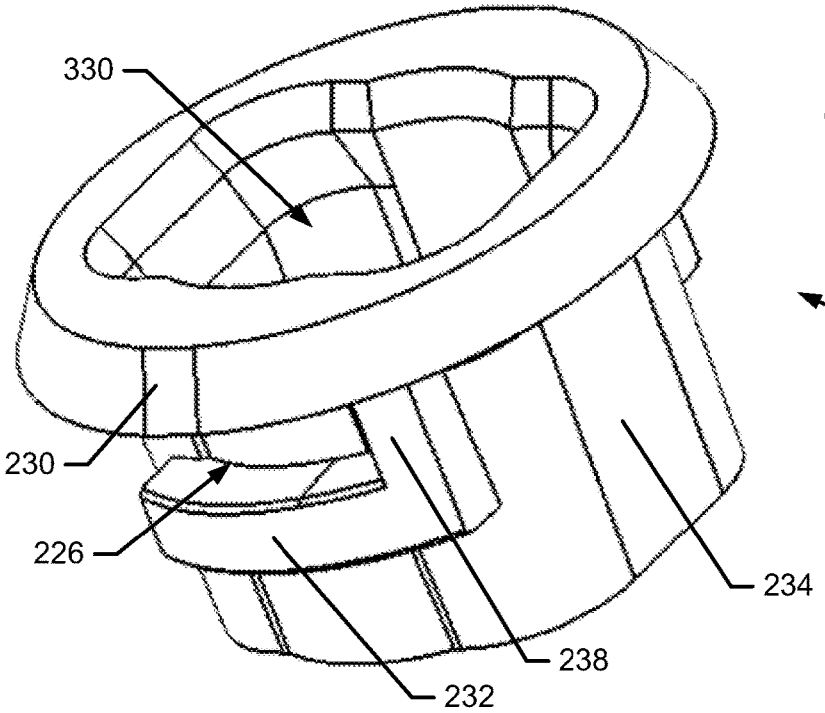
FIG. 9A illustrates a top perspective view of the locking member in accordance with an example embodiment.
Figure 9B:
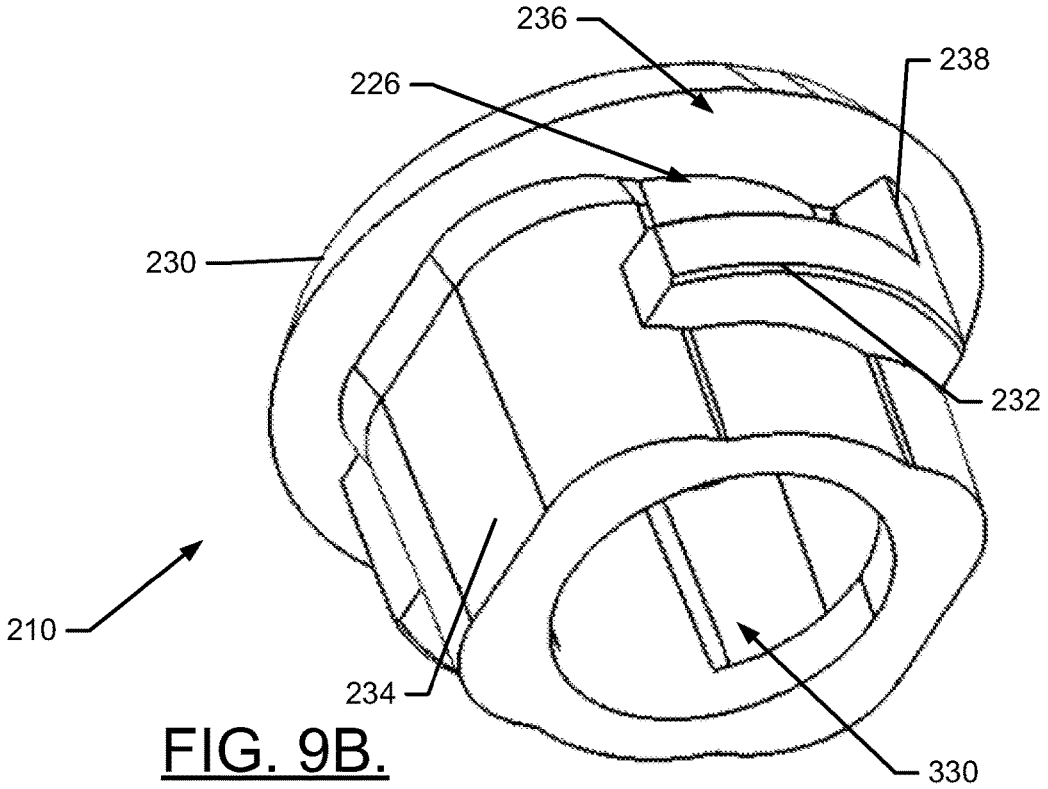
FIG. 9B illustrates a top perspective view of the locking member in accordance with an example embodiment.
Figure 9C:
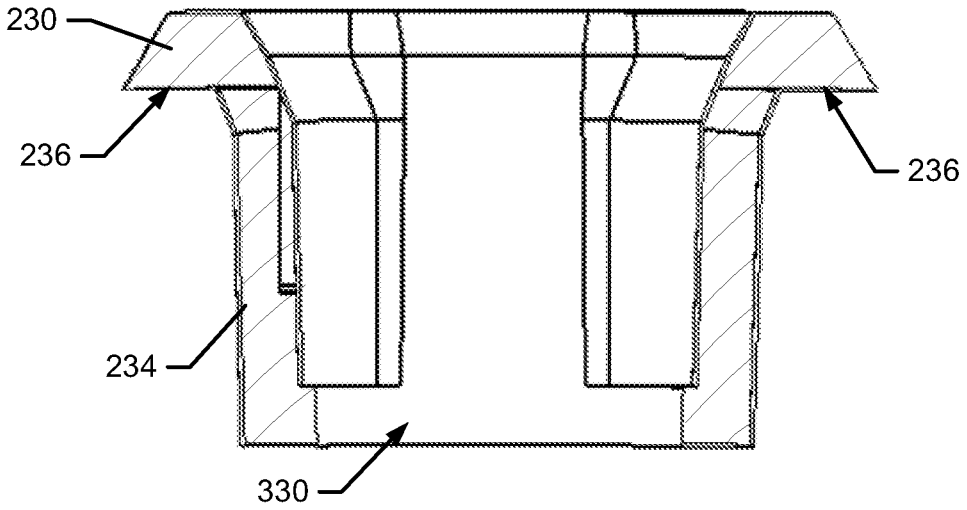
FIG. 9C, illustrates a cross section view of the locking member in accordance with an example embodiment.

FIG. 6, which is defined by FIGS. 6A and 6B, illustrates an interface portion 200 of the housing 110, and a locking member 210 of the seating assembly 180. In this regard, FIG. 6A illustrates a perspective view of the housing 110 with the interface portion 200 exposed and the locking member 210 removed. Meanwhile, FIG. 6B illustrates the same perspective view with the locking member 210 (isolated from the rest of the seating assembly 180) operably coupled to the interface portion 200. FIG. 7, which is defined by FIGS. 7A and 7B, illustrates various perspective views of the seating assembly 180 (isolated from the rest of the chalk box 100) to show how the components of the seating assembly 180 fit together when fully assembled. FIG. 8 illustrates an exploded view of the seating assembly 180. Finally, FIG. 9, which is defined by FIGS. 9A, 9B and 9C, illustrates various views of the locking member 210 in isolation (FIGS. 9A and 9B) and in cross section (FIG. 9C).

Referring now to FIGS. 6-9, it can be appreciated that the nozzle or seating assembly 180 is held to the remainder of the housing 110 by the operable coupling of the locking member 210 to the interface portion 200. In this regard, various structures of the locking member 210 to the interface portion 200 interact with each other to hold the seating assembly 180 to the housing 110 after a quarter-turn locking motion is performed subsequent to initial alignment of the interlocking features of the locking member 210 and the interface portion 200. Some of these interlocking features are visible in FIG. 6A.

FIG. 6A shows a reception cavity 220 that is in alignment with a reservoir exit cavity 222 via which the string 140 leaves the chalk reservoir 160. As will be discussed below, a portion of the seating assembly 180 may be configured to interface with each of the reservoir exit cavity 222 and the reception cavity 220. Both the reservoir exit cavity 222 and the reception cavity 220 may generally have circular shapes. However, the reception cavity 220 of this example embodiment includes interlocking features in the form of locking protrusions 224 that extend radially inwardly along opposing respective surfaces of the internal periphery of the reception cavity 220. The locking protrusions 224 may be received in a locking slot 226 (see FIG. 7) formed on respective outer radial edges of the locking member 210. The locking slot 226 may be formed between a gasket portion 230 of the locking member 210 and a locking arm 232 that extends radially outwardly from each opposing side of a base portion 234 of the locking member 210.

The base portion 234 may extend along an axial direction away from the gasket portion 230. The gasket portion 230 may include a sealing surface 236 that lies in a plane that is substantially perpendicular to the axial direction. The sealing surface 236 faces toward the reception cavity 220 and extends around all peripheral edges thereof when the locking protrusions 224 are locked into the locking slot 226. In an example embodiment, the seating assembly 180 may be rotated about 90 degrees (counterclockwise in this example) relative to the housing 110 and inserted into the housing 110 such that the locking member 210 is passed through the reception cavity 220 and toward the reservoir exit cavity 222. In this position, the locking protrusions 224 may be axially aligned with the locking slot 226, but not radially aligned therewith (and therefore the locking protrusions 224 may not be disposed within the locking slot 226. The sealing surface 236 may be seated upon the top surface of the housing 110, which surrounds the reception cavity 220. Thereafter, the seating assembly 180 may be turned 90 degrees (e.g., clockwise in this example) so that the locking protrusions 224 are each turned to pass into a respective one of the locking slots 226.

A blocking member 238 may extend between the sealing surface 236 of the gasket portion 230 and the locking arm 232 to define a maximal rotational movement that is allowed when the seating assembly 180 is rotated. When the seating assembly 180 has been rotated in the manner described above, the locking protrusions 224 may be axially and radially aligned with the locking slots 226 on each opposing side of the locking member 210, and the seating assembly 180 may be locked into connection with the housing 110. However, the seating assembly 180 could be rotated back in the opposite direction (i.e., counterclockwise in this example) to remove the locking protrusions 224 from the locking slots 226 to allow separation of the seating assembly 180 from the housing 110.

The locking mechanism described above is facilitated by the further locking of the locking member 210 to the other portions of the seating assembly 180. In this regard, the seating assembly 180 may include a shell 300 that is configured to correspond to the outer shape of the housing 110 and to form the reception cavity 182 described above for receipt of the end hook 170. The shell 300 may be formed by molding and, in some cases, may include an inner shell 302 and an outer shell 304 that can be mated together. In an example embodiment, the inner and outer shells 302 and 304 may be co-molded. However, in other cases, the outer shell 304 may be overmolded onto the inner shell 302 (or vice versa).

The reception cavity 182 may extend downward into a stem portion 310 that terminates (when assembled with the housing 110) at the reservoir exit cavity 222, and is sized to mate therewith. An outer surface of the stem portion 310 and the portions of the inner shell 302 or outer shell 304 that form the reception cavity 182 may be shaped complementary to the inner surfaces of a stem receiver 330 formed axially along the center of the locking member 210. Accordingly, the stem portion 310 may pass through the stem receiver 330 and the locking member 210 may be moved up along the stem portion 310 until a tight fit therewith is achieved.

As shown best in FIG. 8, a wiping member 340 may be inserted into the distal end of the stem portion 310 to seal the reception cavity 182 with respect to chalk escape from the chalk reservoir 160. The wiping member 340 may have a crease 342 formed therein, and the string 140 may pass through the crease 342 before reaching the end hook 170. As the string 140 is withdrawn from the chalk box 100, the wiping member 340 may wipe away excess chalk, while otherwise retaining chalk inside the chalk reservoir 160. The wiping member 340 may be made of felt or some other material that can both plug the opening formed at the distal end of the stem portion 310 and also wipe away excess chalk from the string 140.

As shown in FIGS. 7 and 8, the wiping member 340 may be retained in position within the stem portion 310 via a locking clamp 350. The locking clamp 350 may extend into pin receivers 352 formed on opposing sides of the stem portion 310 and extend downward along the stem portion 310 to at least partially cover or extend across the opening formed at the distal end of the stem portion 310. The part of the locking clamp 350 that extends across the opening holds the wiping member 340 inside the opening and within the stem portion 310. Meanwhile, a washer 360 may be provided between the locking clamp 350 and the locking member 310. The pins 354 of the locking clamp 350 may extend into the pin receivers 352, and the pins 354 may also abut the washer 360 to prevent movement of the washer 360 toward the distal end of the stem portion 310. Accordingly, the pins 354 of the locking clamp 350 may effectively lock the locking member 210 in place on the stem portion 310 axially since the washer 360 prevents axial movement of the locking member 210.

Given that the locking member 210 is secured axially onto the stem portion 310, when the quarter turn movement described above is performed, the seating assembly 180 is effectively locked onto the housing 110. Moreover, the locking of the seating assembly 180 onto the housing 110 causes the sealing surface 236 to extend around all peripheral edges of the reception cavity 220 forming a seal between the sealing surface 236 and the housing 110.

In an example embodiment, the gasket portion 230 and the base portion 234 of the locking member 110 may be part of one component, so that no O-ring or rubber gasket needs to be included as a separate component. As noted above, this reduces part count and simplifies the assembly of the chalk box 100. In some cases, the gasket portion 230 and the base portion 234 can be co-molded or overmolded with respect to each other so that, for example, complex shapes (i.e., non-circular profiles) can be molded for the base portion 234. The base portion 234 of this example does not have a simple circular profile, which more readily enables shaping the base portion 234 to fit between the locking protrusions 224 prior to rotation into the locked position where the locking protrusions 224 become retained in the locking slots 226. Additionally, the material (e.g., resin, plastic, and/or the like) used in molding the gasket portion 230 may be far less likely to be torn, lost or otherwise get deformed or damaged during handling than a rubber gasket. In some examples, the gasket portion 230 may be made of thermoplastic elastomer (TPE), thermoplastic rubber (TPR) or the like, which can be co-molded or overmolded with the base portion 234 in order to integrate the gasket portion 230 into the nozzle or seating assembly 180 itself, without requiring any additional gasket portion. In this regard, the gasket is integrated directly into the locking components themselves rather than being a separate component interposed therebetween.

As can be appreciated from the descriptions above, the reception cavity 220 and the locking protrusions 224 may combine to form a case flange assembly. Meanwhile, the sealing surface 236, the locking arms 232 and the blocking member 238 of the locking member 210 may combine to form a nozzle flange assembly. The nozzle flange assembly and the case flange assembly may be configured to form a quarter-turn interlocking feature that locks the nozzle (i.e., the seating assembly 180) to the housing 110 of the chalk box 100. However, unlike conventional designs that interpose a rubber gasket between the case flange and the nozzle flange, example embodiments integrate a gasket portion into the locking member 210. As noted above, this reduces part count, simplifies construction and also makes the final product more resilient and robust.

In an example embodiment, a chalk box is provided. The chalk box may include a housing having an aperture, a reel assembly enclosed within the housing, a string having a first end operably coupled to an end hook and configured to extend from the housing through the aperture and having a second end configured to be wound on the reel assembly, a chalk reservoir in which the string is retained or through which the string passes prior to extending out of the aperture, and a nozzle. The nozzle may be configured to be releasably coupled with the housing. The nozzle may include a shell, and a nozzle flange assembly configured to interface with a case flange assembly of the housing to operably couple the nozzle to the housing. The nozzle flange assembly may include a locking member. A gasket portion may be integrated into the locking member to seal an interface between the nozzle flange assembly and the case flange assembly to inhibit chalk leakage from the chalk box.

In some embodiments, the features of the device described above may be augmented or modified, or additional features may be added. These augmentations, modifications and additions may be optional and may be provided in any combination. Thus, although some example modifications, augmentations and additions are listed below, it should be appreciated that any of the modifications, augmentations and additions could be implemented individually or in combination with one or more, or even all of the other modifications, augmentations and additions that are listed. As such, for example, the case flange assembly may include locking protrusions extending radially inwardly from a periphery of a reception cavity, and the nozzle flange assembly may include locking slots formed at opposite side portions of the locking member and configured to receive the locking protrusions responsive to a quarter turn of the nozzle when the locking protrusions and the locking slots are aligned. In an example embodiment, the locking slots may be formed between a sealing surface of the gasket portion and a locking arm formed on a base portion of the locking member. In some cases, the sealing surface is made of thermoplastic elastomer (TPE) or thermoplastic rubber (TPR) that is co-molded or overmolded with material (which could be the same material as that of the sealing surface or different therefrom) to form the base portion. In an example embodiment, the sealing surface may surround peripheral edges of the reception cavity. In an example embodiment, the nozzle may be operably coupled to the housing such that the string extends radially outwardly from the reel assembly through a wiping member disposed at a stem portion of the nozzle. In some cases, the wiping member may be held in the stem portion by a locking clamp, and the locking clamp further holds the locking member in axial position relative to the stem portion. In an example embodiment, a stem receiver may be formed along an axial center of the locking member, the stem portion may be received within the stem receiver, an external profile of the stem portion matches an internal profile of the stem receiver, and a washer may be disposed between the locking member and the locking clamp to fix the axial position of the locking member. In some cases, the nozzle may include a shell including an inner shell and an outer shell overmolded with respect to the inner shell.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A chalk box comprising:

a housing having an aperture;

a reel assembly enclosed within the housing; a string having a first end operably coupled to an end hook and configured to extend from the housing through the aperture and having a second end configured to be wound on the reel assembly;

a chalk reservoir in which the string is retained or through which the string passes prior to extending out of the aperture; and a nozzle comprising a shell and a nozzle flange assembly, the nozzle being configured to be releasably coupled with the housing proximate to the aperture to interface with the end hook, wherein the housing comprises a case flange assembly and the nozzle flange assembly comprises a locking member, the nozzle flange assembly being configured to interface with the case flange assembly to operably couple the nozzle to the housing, and wherein a gasket portion is integrated into the locking member to seal an interface between the nozzle flange assembly and the case flange assembly to inhibit chalk leakage from the chalk box.

2. The chalk box of claim 1, wherein the case flange assembly comprises locking protrusions extending radially inwardly from a periphery of a reception cavity, and wherein the nozzle flange assembly comprises locking slots formed at opposite side portions of the locking member and configured to receive the locking protrusions responsive to a quarter turn of the nozzle when the locking protrusions and the locking slots are aligned.

3. The chalk box of claim 2, wherein the locking slots are formed between a sealing surface of the gasket portion and a locking arm formed on a base portion of the locking member.

4. The chalk box of claim 3, wherein the sealing surface is made of thermoplastic elastomer (TPE) or thermoplastic rubber (TPR) that is co-molded with material to form the base portion.

5. The chalk box of claim 3, wherein the sealing surface is made of thermoplastic elastomer (TPE) or thermoplastic rubber (TPR) that is overmolded with material used to form the base portion.

6. The chalk box of claim 3, wherein the sealing surface surrounds peripheral edges of the reception cavity.

7. The chalk box of claim 1, wherein the nozzle is operably coupled to the housing such that the string extends radially outwardly from the reel assembly through a wiping member disposed at a stem portion of the nozzle.

8. The chalk box of claim 7, wherein the wiping member is held in the stem portion by a locking clamp, and wherein the locking clamp further holds the locking member in axial position relative to the stem portion.

9. The chalk box of claim 8, wherein a stem receiver is formed along an axial center of the locking member, wherein the stem portion is received within the stem receiver, wherein an external profile of the stem portion matches an internal profile of the stem receiver, and wherein a washer is disposed between the locking member and the locking clamp to fix the axial position of the locking member.

10. A chalk box comprising:

a housing having an aperture;

a reel assembly enclosed within the housing; a string having a first end operably coupled to an end hook and configured to extend from the housing through the aperture and having a second end configured to be wound on the reel assembly;

a chalk reservoir in which the string is retained or through which the string passes prior to extending out of the aperture; and a nozzle configured to be releasably coupled with the housing proximate to the aperture to interface with the end hook, wherein the housing comprises a case flange assembly and the nozzle comprises a nozzle flange assembly including a locking member, and wherein a gasket portion is integrated into the locking member to seal an interface between the nozzle flange assembly and the case flange assembly;

wherein the nozzle comprises a shell including an inner shell and an outer shell overmolded with respect to the inner shell.

11. A nozzle for a chalk box including a housing and a chalk reservoir, the nozzle being configured to be releasably coupled with the housing, the nozzle comprising:

a shell; and a nozzle flange assembly configured to interface with a case flange assembly of the housing to operably couple the nozzle to the housing, wherein the nozzle flange assembly includes a locking member, and wherein a gasket portion is integrated into the locking member to seal an interface between the nozzle flange assembly and the case flange assembly to inhibit chalk leakage from the chalk box.

12. The nozzle of claim 11, wherein the case flange assembly comprises locking protrusions extending radially inwardly from a periphery of a reception cavity disposed at a portion of the housing, and wherein the nozzle flange assembly comprises locking slots formed at opposite side portions of the locking member and configured to receive the locking protrusions responsive to a quarter turn of the nozzle when the locking protrusions and the locking slots are aligned.

13. The nozzle of claim 12, wherein the locking slots are formed between a sealing surface of the gasket portion and a locking arm formed on a base portion of the locking member.

14. The nozzle of claim 13, wherein the sealing surface is made of thermoplastic elastomer (TPE) or thermoplastic rubber (TPR) that is co-molded with material to form the base portion.

15. The nozzle of claim 13, wherein the sealing surface is made of thermoplastic elastomer (TPE) or thermoplastic rubber (TPR) that is overmolded with material used to form the base portion.

16. The nozzle of claim 13, wherein the sealing surface surrounds peripheral edges of the reception cavity.

17. The nozzle of claim 11, wherein the nozzle is operably coupled to the housing such that the string extends radially outwardly from the reel assembly through a wiping member disposed at a stem portion of the nozzle.

18. The nozzle of claim 17, wherein the wiping member is held in the stem portion by a locking clamp, and wherein the locking clamp further holds the locking member in axial position relative to the stem portion.

19. The nozzle of claim 18, wherein a stem receiver is formed along an axial center of the locking member, wherein the stem portion is received within the stem receiver, wherein an external profile of the stem portion matches an internal profile of the stem receiver, and wherein a washer is disposed between the locking member and the locking clamp to fix the axial position of the locking member.

20. The nozzle of claim 11, wherein the nozzle comprises a shell including an inner shell and an outer shell overmolded with respect to the inner shell.

* * * * *